US009023756B2

(12) United States Patent
Shimizu et al.

(10) Patent No.: US 9,023,756 B2
(45) Date of Patent: May 5, 2015

(54) THERMOSENSITIVE RECORDING MATERIAL

(75) Inventors: Kenji Shimizu, Shizuoka (JP); Hideo Aihara, Shizuoka (JP); Daiki Iwata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/005,444

(22) PCT Filed: Jul. 27, 2012

(86) PCT No.: PCT/JP2012/069779
§ 371 (c)(1),
(2), (4) Date: Sep. 16, 2013

(87) PCT Pub. No.: WO2013/018875
PCT Pub. Date: Feb. 7, 2013

(65) Prior Publication Data

US 2014/0148334 A1 May 29, 2014

(51) Int. Cl.

| | |
|---|---|
| ***B41M 5/30*** | (2006.01) |
| ***B41M 5/41*** | (2006.01) |
| ***B41M 5/44*** | (2006.01) |

(52) U.S. Cl.
CPC . *B41M 5/44* (2013.01); *B41M 5/30* (2013.01); *B41M 2205/04* (2013.01); *B41M 2205/36* (2013.01); *B41M 5/41* (2013.01)

(58) Field of Classification Search
CPC ..... B41M 5/30; B41M 5/41; B41M 5/44; B41M 2205/04; B41M 2205/36
USPC ..... 503/200, 226
See application file for complete search history.

(56) References Cited

U.S. PATENT DOCUMENTS

| | | | |
|---|---|---|---|
| 5,189,007 | A | 2/1993 | Aihara et al. |
| 5,229,349 | A | 7/1993 | Kurisu et al. |
| 5,482,911 | A | 1/1996 | Hiroishi et al. |
| 5,792,724 | A | 8/1998 | Suzaki et al. |
| 5,866,507 | A | 2/1999 | Suzaki et al. |
| 5,935,899 | A | 8/1999 | Suzaki et al. |
| 5,952,263 | A | 9/1999 | Suzaki et al. |
| 6,060,427 | A | 5/2000 | Mori et al. |
| 7,985,711 | B2 | 7/2011 | Tohmatsu et al. |
| 2009/0075817 | A1 | 3/2009 | Aihara et al. |
| 2009/0215622 | A1 | 8/2009 | Okada et al. |
| 2009/0239746 | A1 | 9/2009 | Aihara |
| 2011/0065575 | A1 | 3/2011 | Shimizu et al. |
| 2011/0224074 | A1 | 9/2011 | Okada et al. |
| 2012/0056936 | A1 | 3/2012 | Shimizu et al. |
| 2012/0062649 | A1 | 3/2012 | Naruse et al. |

FOREIGN PATENT DOCUMENTS

| | | |
|---|---|---|
| JP | 05-318926 | 12/1993 |
| JP | 06-227119 | 8/1994 |
| JP | 07-164742 | 6/1995 |
| JP | 09-220857 | 8/1997 |
| JP | 10-297101 | 11/1998 |
| JP | 11-123875 | 5/1999 |
| JP | 2002-052830 | 2/2002 |
| JP | 2003-276330 | 9/2003 |
| JP | 2004-284089 | 10/2004 |
| JP | 2005-081626 | 3/2005 |
| JP | 2007-223257 | 9/2007 |

OTHER PUBLICATIONS

International Search Report Issued for counterpart International Patent Application No. PCT/JP2012/069779 dated Sep. 4, 2012.
U.S. Appl. No. 06/874,950, filed Jun. 16, 1986.
U.S. Appl. No. 07/805,046, filed Dec. 11, 1991.
U.S. Appl. No. 08/156,892, filed Nov. 24, 1993.

*Primary Examiner* — Bruce H Hess
(74) *Attorney, Agent, or Firm* — Cooper & Dunham LLP

(57) ABSTRACT

To provide a thermosensitive recording material, which contains: a support; a thermosensitive recording layer provided on one surface of the support; and a back layer provided on the other surface of the support, wherein the support has a surface formed of a resin, and wherein the back layer contains a combination of a core-shell acrylic resin and an oxazoline resin, or a reaction product thereof, or both thereof.

10 Claims, No Drawings

THERMOSENSITIVE RECORDING MATERIAL

TECHNICAL FIELD

The present invention relates to a thermosensitive recording material.

BACKGROUND ART

Currently, various recording materials have been studied and developed for practical use in the field of information recording.

Among these recording materials, thermosensitive recording materials have the following advantages: (1) a simple image recording is realized only by a heating process, and (2) mechanisms of a device is simple, downsizing thereof is easily achieved, and a recording material is easily handled and at low cost.

Accordingly, thermosensitive recording materials are used in a wide range of fields, including an information processing field (output of an electronic desk calculator, or a computer), a field of recorders for medical instrumentation, a field of low speed and high speed facsimiles, a field of automatic ticket benders (for railway tickets, or admission tickets), a thermosensitive copying field, a field of labels for a POS system, and a field of tabs. For example, to satisfy the properties suitable for various uses, such as a label to be adhered to a surface of a moisture vapor resistant wrapping material, and a label capable of peeling after adhered once, thermosensitive recording materials are required to satisfy various properties, such as physical strength resistant to bending or breaking, dimensional stability, and water insolubility, at the same time. From these reasons, synthetic paper or synthetic resin films are often used as a support of a thermosensitive recording material.

In the fields of labels for POS system and tabs, especially, thermosensitive recording materials are often used with an adhesive layer provided on a back side thereof. There are diverse range of the adhesives used for the back side, such as an adhesive intended for permanent bonding, an adhesive intended for releasing and re-adhering, and an adhesive capable of exhibiting adhesion at low temperature, which is used for a label for frozen food products.

In the case where synthetic paper or plastic film having higher smoothness than that of paper is used as a support, curling of a thermosensitive recording material may occur, especially when an adhesive layer is provided thereto. When a back layer is provided between a support and an adhesive layer, moreover, adhesion between the back layer and the support reduces, which may cause peeling from the portion at which the adhesion is weakened.

It has not yet been fully discovered why peeling or curling of a thermosensitive recording material occurs, but it is assumed that low molecular weight components, such as a plasticizer, a tackifier (a tackiness imparting agent), and an emulsifier, contained in an adhesive used in an adhesive layer migrate into a back layer or a support, in the case where a support is synthetic paper or a plastic film, to thereby reduce adhesion to with the back layer, or to thereby impart plasticity to one side of the support.

PTL 1 discloses that a back coat layer is provided on a back surface of a paper support of thermosensitive recording paper, where the back coat layer contains a core-shell acrylic emulsion and an inorganic pigment having oil absorption of lower than 50 mL/100 g, to improve adhesion of an adhesive layer to the back coat layer, and water resistance. This back coat layer however has problems that film forming ability and barrier properties are insufficient, and peeling or curling may occur when the support is synthetic paper or a plastic film.

Moreover, there is disclosed that the back coat layer is cured by a curing agent. However, this description merely teaches that the curing agent can be used for the purpose of enhancing water resistance of a cellulose base support, but not for preventing reduction in adhesion strength due to organic materials, which are easily migrated, contained in an adhesive or support.

PTL 2 discloses that a paper support is coated with a thermosensitive layer and a protective layer, followed by coated with a back coat layer to correct the curl formed during the formation of the thermosensitive layer and the protective layer. Moreover, there is a description that a core-shell acrylic resin can be used in the back coat layer, but the core-shell acrylic resin is used therein for the purpose of improving water resistance of hydrophilic paper, not for preventing a problem caused by migration of organic materials in an adhesive or support.

In the case where the strength of the back coat layer itself, and adhesion between the back coat layer and the support are insufficient, pealing or curling of the thermosensitive recording material using synthetic paper or a plastic film as the support partially occurs as time passes.

Moreover, we have previously proposed in PTL 3 that a back layer is provided between a back surface of a support and adhesive layer of a thermosensitive recording material, where the back layer contains non-foamable plastic hollow filler, a styrene-acryl copolymer having an acid value of 200 or greater and Tg of 80° C. or higher, and an acrylic emulsion resin, and is reinforced with potassium zirconium carbonate, and ammonium zirconium carbonate. This technique is to prevent peeling between the back layer and the adhesive layer by a crosslink reaction with an acrylic adhesive in the adhesive layer, not directed to prevention of peeling between the back layer and the support.

Further, the back layer of this thermosensitive recording material has barrier properties to some extent, but PTL 3 does not tech or suggest a problem caused by volatile organic materials contained in the adhesive. Therefore, such thermosensitive recording material cannot be used for various purposes, and curling thereof may occur due to partial peeling, depending on an adhesive for use.

CITATION LIST

Patent Literature

PTL 1: Japanese Patent Application Laid-Open (JP-A) No. 06-227119
PTL 2: JP-A No. 2003-276330
PTL 3: JP-A No. 2005-81626

SUMMARY OF INVENTION

Technical Problem

The present invention aims to provide a thermosensitive recording material, which has excellent adhesion between a support whose surface is formed of a resin and a back layer, has excellent water resistance and stability of a back layer coating liquid, and does not cause peeling or curling of a back layer even when an adhesive is provided thereon.

Solution to Problem

The present invention has been accomplished based on the insight that a back layer for a resinous support of a thermosensitive layer, which is formed of a certain water-dispersible polymer and a certain crosslinking agent, has excellent water resistance, adhesion, and durability.

The present invention is based upon the aforementioned insights of the present inventors, and the means for solving the aforementioned problems are as follows:

<1> A thermosensitive recording material, containing:

a support;

a thermosensitive recording layer provided on one surface of the support; and a back layer provided on the other surface of the support, wherein the support has a surface formed of a resin, and wherein the back layer contains a combination of a core-shell acrylic resin and an oxazoline resin, or a reaction product thereof, or both thereof.

<2> The thermosensitive recording material according to <1>, wherein the oxazoline resin is contained in an amount of 0.1 parts to 1.2 parts relative to 1 part of the core-shell acrylic resin.

<3> The thermosensitive recording material according to any of <1> or <2>, wherein the support is synthetic paper.

<4> The thermosensitive recording material according to <3>, wherein the synthetic paper contains polypropylene.

<5> The thermosensitive recording material according to any of <1> to <4>, wherein the surface of the support on which the back layer is provided has wetting index of 40 dyn/cm or higher.

<6> The thermosensitive recording material according to any one of <1> to <5>, wherein the back layer further contains an antistatic agent.

<7> The thermosensitive recording material according to <6>, wherein the antistatic agent is acrylic polymer.

<8> The thermosensitive recording material according to any one of <1> to <7>, further comprising an adhesive layer provided on the back layer.

<9> The thermosensitive recording material according to <8>, wherein the adhesive layer contains a releasable weak adhesive.

<10> The thermosensitive recording material according to <8>, wherein the adhesive layer contains a hot-melt adhesive.

Advantageous Effects of Invention

As can be understood from the following specific and concrete descriptions, the present invention can provide a thermosensitive recording material, which has excellent adhesion between a resinous support and a back layer of the thermosensitive recording material, has excellent water resistance and stability of a back layer coating liquid, and does not cause peeling or curling of the back layer even when an adhesive is provided thereon.

DESCRIPTION OF EMBODIMENTS

The thermosensitive recording material of the present invention will be specifically explained hereinafter.

(Thermosensitive Recording Material)

The thermosensitive recording material of the present invention contains a support, and a back layer, and may further contain other layers, such as an adhesive layer, a protective layer, and an intermediate layer, if necessary.

<Back Layer>

The back layer contains a reaction product between a water-dispersible polymer and a crosslinking agent, and may further contain other components, such as an antistatic agent, if necessary.

<<Water-Dispersible Polymer>>

The water-dispersible polymer contains a core-shell acrylic resin. The core-shell acrylic resin contains: a core including as an essential component a polymer material containing an extremely highly hydrophilic group, such as an acrylonitrile group; and a shell containing as an essential component a copolymer of a hydrophilic polymer material, such as methacryl amide, and (meth)acrylic acid. Moreover, the core-shell acrylic resin, after subjected to crosslinking treatment with a certain crosslinking agent, has excellent barrier properties, water resistance, and film-forming ability.

Such core-shell acrylic resin has been known in the art through JP-A Nos. 06-227119, 09-254555, and 2000-158815. For example, a commercial product on the market under the name of BARIASTAR (manufactured by Mitsui Chemicals, Inc.) can be used as the core-shell acrylic resin.

Moreover, another resin can be used in combination, provided that it does not adversely affect excellent barrier properties, water resistance, and film forming ability of the certain crosslinked product of the core-shell acrylic resin.

Examples of the resin used in combination with the core-shell acrylic resin include styrene-butadiene latex, an acrylic resin emulsion, a styrene-maleic anhydride copolymer, modified starch, casein, starch, hydroxyethyl cellulose, polyvinyl alcohol, modified polyvinyl alcohol, and gelatine.

An amount of the core-shell acrylic resin is determined depending on the intended use of the thermosensitive recording material, but it is preferably 50% by mass or greater with respect to the water-dispersible polymer, more preferably 70% by mass or greater, and even more preferably 90% by mass or greater.

<<Crosslinking Agent>>

The crosslinking agent is an oxazoline resin. The oxazoline resin has a molecular structure having a polymer chain (acryl or styrene) as a principle chain, and oxazoline groups, which are weak Lewis base, grafted to the polymer chain.

The oxazoline group is bonded to the core-shell acrylic resin by a crosslink reaction, or graft copolymerization reaction tough various reaction with carboxyl groups present on a surface of the core-shell acrylic resin, such as cleaving a ring structure of the oxazoline group to bond to a carboxyl group, and bonding to a carboxyl group, as it is. As a result, barrier properties, water resistance, solvent resistance, heat resistance, and strength are improved. The oxazoline resin is particularly very effective for preventing peeling of the back layer due to low molecular substances, such as an emulsifier, and a tackifier.

The oxazoline resin is highly reactive with a carboxyl group, but the reactivity thereof at ambient temperature is lower than that of an aziridine group, and improves stability of a back layer coating liquid as gelation is inhibited.

An amount of the oxazoline resin is preferably 0.1 parts to 1.2 parts relative to 1 part of the core-shell acrylic resin, more preferably 0.2 parts to 0.8 parts. When the amount thereof is smaller than 0.1 parts, water resistance may be impaired. When the amount thereof is greater than 1.2 parts, barrier properties may be low, which may cause pealing.

A coating amount of the back layer is preferably 1 $g/m^2$ to 5 $g/m^2$. When the amount thereof is smaller than 1 $g/m^2$, the barrier properties are not sufficient, and peeling or curing may occur due to low molecular substances contained in an adhesive layer.

—Antistatic Agent—

The back layer of the thermosensitive recording material of the present invention may contain an antistatic agent, if necessary.

As for the antistatic agent, various substances have been known. As for the antistatic properties of the back layer, the surface electrical resistance thereof needs to be $10^{10}$ Ωcm or lower.

As for antistatic agents that can impart such conductivity, there are mainly an antistatic agent using a surfactant, an antistatic agent using an electric conductive polymer, and an antistatic agent using electric conductive metal oxide.

The antistatic agent using the surfactant is available at relatively low cast, in wide varieties, and has excellent antistatic properties. However, most of the antistatic agents using the surfactant realize the conductivity by absorption of moisture by the surfactant itself. Moreover, most of the electric conductive metal oxides highly hydroscopic. Accordingly, these antistatic agents tend to be influenced by humidity, and may lower water resistance of a resulting back layer. From the reasons above, the antistatic agent using electric conductive polymer is preferable. Among them, an antistatic agent using acrylic polymer can be preferably used, as it has high antistatic properties, and hardly affects water resistance of a resulting back layer.

An amount of the antistatic agent is preferably 25 parts or smaller relative to 100 parts by mass of the solid content of the back layer.

<Support>

The support is appropriately selected depending on the intended purpose without any limitation, provided that it is a support whose surface is formed of a resin, and examples thereof include synthetic paper formed mainly of a synthetic resin, a plastic film, laminate paper, and coat paper. Among them, synthetic paper is preferable.

As for the synthetic resin, those mainly composed of conventional polyolefin (e.g., polyethylene and popypropylene), polyester (e.g., polyethylene terephthalate, and polybutylene terephthalate), cellulose derivatives (e.g., cellulose triacetate), polyethylene naphthalate, or polystyrene.

As for the synthetic paper, those produced by adding inorganic fillers and trace of additives to a synthetic resin, and forming a film by biaxial stretching, those produced by using as a raw material resin fibers formed of a synthetic resin, instead of pulp, adding a binder thereto, and making it into paper by means of a paper machine, and those improving water resistance and mechanical strength by laminating a surface of a base, which is conventional paper, can be used. Examples of the synthetic resin include polypropylene.

Moreover, the density of the support whose surface is formed of a resin is preferably 60 g/m$^3$ to 150 g/m$^3$. More preferably, the support is a low-density support of 60 g/m$^3$ to 90 g/m$^3$, as better coloring ability can be attained. When the support has low density, there are many air spaces within the support, which give excellent heat insulation effect, improving a coloring ability of a resulting thermosensitive recording material by effectively absorbing thermal energy applied from a thermal head with a thermosensitive recording layer.

When the density thereof is greater than 90 g/m$^3$, coloring ability may reduce, as thermal insulation effect reduces. When the density thereof is lower than 60 g/m$^3$, the support has insufficient strength, which may impair dimensional stability, and physical strength, and does not have functions required as synthetic paper or a plastic film, and therefore it is not practical.

The wetting index of the surface of the support at the side of the hack layer is preferably 30 dyn/cm or greater, more preferably 40 dyn/cm or greater. When the wetting index is less than 30 dyn/cm, it may be difficult to form a coating film of the back layer.

The term "wetting index" used in the present specification is a value measured by a wetting test specified in JIS K6768. Specifically, it is a value measured by immersing a cotton swab in a commercially available wetting standard reagent, and applying the reagent onto a surface of the support.

<Adhesive Layer>

The thermosensitive recording material of the present invention may contain an adhesive layer provided on the back layer, if necessary.

Since the back layer used in the present invention has excellent barrier properties, and is hardly influenced by an adhesive, an adhesive layer containing various adhesives used in a conventional thermosensitive recording material can be provided on the back layer depending on the intended use of the thermosensitive recording material. As for the adhesive, for example, a common adhesive, a releasable weak adhesive, an adhesive for freezing, and a hot-melt adhesive can be used.

The adhesive layer is prepared by applying the adhesive by means of any of conventional bar coaters, roller coaters, applicators, and hot-melt coaters, followed by drying the applied adhesive by hot-air drying, or application of infrared rays, microwaves, or high frequency waves.

The coating amount of the adhesive is adjusted in the approximate range of 5 g/m$^2$ to 50 g/m$^2$ in dry weight. The adhesive may be applied on a surface of a release paper on which a releasing agent had been provided. Alternatively, the adhesive may be applied on the back layer of the thermosensitive recording material.

<Thermosensitive Recording Layer>

The thermosensitive recording layer is prepared by applying a thermosensitive recording layer coating liquid onto one surface of the support, and drying the applied coating liquid, where the thermosensitive recording layer coating liquid is prepared by pulverizing typically water as a dispersion medium, together with or separately, a leuco dye, and an electron-accepting acid compound, and optionally a sensitizer, and a shelf stability improving agent by means of a stirring and pulverizing device, such as a ball mill, an attritor, and a sand mill, to give an average particle diameter of 2 μm or smaller, followed by adding an aqueous binder thereto. The coating amount after drying is typically 2 g/m$^2$ to 8 g/m$^2$, and preferably about 3 g/m$^2$ to 6 g/m$^2$. Moreover, a smoothing treatment performed on a surface of the thermosensitive recording layer by super calendering, gloss calendering, or machine calendering can improve recording density and sensitivity.

The leuco dye for use in the present invention is an electron-donating compound, and it may be used independently or as a mixture of two or more. The leuco dye is a colorless or pale color dye precursor, and is selected from those known in the art without any limitation. Examples of the leuco dye include leuco compounds such as a triphenylmethane phthalide leuco compound, a triallyl methane leuco compound, a fluoran leuco compound, a phenothiazine leuco compound, a thiofluoran leuco compound, a xanthene leuco compound, an indophthalyl leuco compound, a spiropyran leuco compound, an azaphthalide leuco compound, a couromeno-pyrazole leuco compound, a methine leuco compound, a rhodamineanilino-lactame leuco compound, a rhodamine lactam leuco compound, a quinazoline leuco compound, a diazaxanthene leuco compound, and a bislactone leuco compound. These may be used independently, or in combination.

The color developer for use in the present invention preferably includes various electron-accepting compounds, such as a phenol compound, an organic or inorganic acid compound, and esters or salts thereof, which develop color as a result of a reaction with the leuco dye upon application of heat. Moreover, these compounds may be used in combination.

Moreover, the thermosensitive recording layer of the present invention may further contain auxiliary additives, which are commonly used for a thermosensitive recording material, together with the leuco dye and color developer, and examples of such additive include a water-soluble polymer and/or an aqueous emulsion resin, fillers, a thermoplastic material, and a surfactant.

Examples of the fillers include: organic powders, such as calcium carbonate, silica, zinc oxide, titanium oxide, aluminum hydroxide, zinc hydroxide, barium sulfate, clay, talc, surface-treated calcium, and surface-treated silica; and organic powders, such as a urea-formalin resin, a styrene methacrylic acid copolymer, and a polystyrene resin. As for the thermoplastic material, for example, a material having a melting point of about 50° C. to about 200° C., such as higher fatty acid and esters thereof, amide and metal salts thereof, various wax, aromatic carboxylic acid-amine condensate, phenyl benzoate, higher linear glycol, dialkyl 3,4-epoxyhexahydrophthalate, higher letone, p-benzylbiphenyl, and other thermoplastic organic compounds.

<Protective Layer>

In the present invention, a protective layer may be provided on the thermosensitive recording layer for the purpose of improving chemical resistance, water resistance, and head matching ability.

The protective layer is mainly composed of a pigment and a resin. As the pigment mainly used, examples thereof include: so inorganic fillers, such as phosphate fibers, potassium titanate, acicular magnesium hydroxide, whisker, talc, mica, glass flakes, calcium carbonate, plate-like calcium carbonate, aluminum hydroxide, plate-like aluminum hydroxide, silica, clay, kaolin, calcined clay, and hydrotalcite; and organic fillers such as a crosslinked polystyrene resin, a urea-formalin resin, a silicone resin, a crosslinked polymethacrylic acid methyl methacrylate resin, and a melamine-formaldehyde resin.

Examples of the resin used in the protective layer include: water-soluble resins such as polyvinyl alcohol, cellulose derivatives, starch and derivatives thereof, carboxyl group-modified polyvinyl alcohol, polyacrylic acid and derivatives thereof, styrene/acrylic acid copolymer and derivatives thereof, poly(meth)acrylamide and derivatives thereof, styrene/acrylic acid/acrylamide copolymer, amino-group modified polyvinyl alcohol, epoxy-modified polyvinyl alcohol, polyethylene imide, aqueous polyester, aqueous polyurethane, isobutylene-maleic anhydride copolymer and derivatives thereof; and others such as polyester, polyurethane, acrylic ester (co)polymer, styrene-acryl copolymer, an epoxy resin, polyvinyl acetate, polyvinylidene chloride, polyvinyl chloride, and derivatives thereof. Among them, the water-soluble resin is preferable.

Further, it is particularly preferred that a water resistant additive be used in combination for improving the water resistance of the protective layer, specific examples thereof include glyoxal, a melamine-formaldehyde resin, a polyamide resin, and a polyamide-epichlorohydrin resin.

Further, other than the aforementioned pigment and resin, auxiliary additives, such as a surfactant, a thermoplastic material, a lubricant, and a pressure-induced coloring inhibitor may be used in the protective layer. In this case, specific examples of the thermoplastic material are those listed in connection with the thermosensitive recording layer.

<Intermediate Layer>

In the present invention, an intermediate layer containing a pigment, a binder, a thermoplastic material, and hollow fillers may be further provided between the support and the thermosensitive recording layer, depending on the necessity for improving coloring ability, smoothness, and adhesion.

A recording method of the thermosensitive recording material of the present invention is not particularly limited, and a thermal pen, thermal head, or leaser heating may be used depending on the intended use of the thermal recording material.

EXAMPLES

The present invention will be more specifically explained through examples, hereinafter, but these examples shall not be construed as to limit the scope of the present invention. Note that, "part(s)" and "%" depicted in the following descriptions are both on mass basis, unless otherwise stated.

Example 1

(1) Preparation of Thermosensitive Recording Layer Coating Liquid

| [Liquid A] Dye dispersion liquid | |
|---|---|
| 3-dibutylamino-6-methyl-7-anilinofluoran | 10 parts |
| 10% aqueous solution of itaconic acid-modified polyvinyl alcohol | 10 parts |
| Water | 30 parts |

| [Liquid B] Developer dispersion liquid | |
|---|---|
| 4-isopropoxy-4'-hydroxydiphenylsulfone | 30 parts |
| di-(p-methylbenzyl) oxalate | 10 parts |
| 10% aqueous solution of itaconic acid-modified polyvinyl alcohol | 50 parts |
| Silica | 15 parts |
| Water | 197 parts |

[Liquid A] and [Liquid B] respectively consisted of the materials in the above formulations were each dispersed by a sand mill to give an average particle diameter of 2 μm or smaller, to thereby prepare a dye dispersion liquid [Liquid A], and a color dispersion liquid [Liquid B].

Subsequently, the prepared dispersion liquids were mixed and stirred with the following formulation, to thereby prepare a thermosensitive recording layer coating liquid [Liquid C].

| [Liquid C] Thermosensitive Recording Layer Coating Liquid | |
|---|---|
| Dye dispersion liquid [Liquid A] | 50 parts |
| Developer dispersion liquid [Liquid B] | 292 parts |

(2) Preparation of Protective Layer Coating Liquid

| [Liquid D] Protective Layer Coating Liquid | |
|---|---|
| Aluminum hydroxide | 10 parts |
| 10% aqueous solution of itaconic acid-modified polyvinyl alcohol | 80 parts |
| 25% polyamide-epichlorohydrin resin | 16 parts |
| 30% dispersion liquid of zinc stearate | 25 parts |
| Water | 164 parts |

Materials in the formulation above were mixed and stirred to thereby prepare a protective layer coating liquid [Liquid D].

(3) Preparation of Back Layer Coating Liquid

| [Liquid E] Back Layer Coating Liquid | |
|---|---|
| Core-shell acrylic emulsion (solid content: 20%) (BARIASTAR B-2000, manufactured by Mitsui Chemicals, Inc.) | 64 parts |
| Oxazoline crosslinking agent (solid content: 39%) (EPOCROSS WS-500, manufactured by Nippon Shokubai Co., Ltd.) | 13 parts |
| Water | 23 parts |

Materials in the formulation above were mixed and stirred to thereby prepare a back layer coating liquid [Liquid E].

Next, on a surface of a 100 μm-thick synthetic resin containing polypropylene (PL-100, of NAN YA PLASTICS CORPORATION, density: 76 g/m$^2$, surface wettability: 32 dyn/cm) serving as a support, the thermosensitive layer coating liquid and the protective layer coating liquid ere sequentially applied to give deposition amounts of 5.0 g/m$^2$ and 3.5 g/m$^2$, respectively, on dry basis, followed by drying. On a back surface of the support, the back layer coating liquid was applied to give a deposition amount of 2.0 g/m$^2$ on dry basis, followed by drying. The resultant was subjected to calendering to provide a surface of the protective layer with Oken type smoothness of about 1,000 seconds. Then, the resultant was cured for 2 days in the en on ent of 40° C., to thereby prepare a thermosensitive recording material of Example 1.

Moreover, the following three adhesive layers were each separately provided on a surface of the back layer. On the adhesive layer, a release paper was provided, and followed by storing for 4 days in an environment of ambient temperature, to thereby prepare three thermosensitive recording materials of Example 1 having different adhesive layers. As for the three different adhesive layers, an adhesive layer prepared by applying a hot melt adhesive (product name: MQ7829W, manufacturer: Henkel Japan) to give a deposition amount of 15 g/m$^2$, an adhesive layer prepared by applying an acryl emulsion adhesive (a common adhesive) (product name: AT1202, manufacturer: SAIDEN CHEMICAL INDUSTRY CO., LTD.) to give a deposition amount of 15 g/m$^2$, and an adhesive layer prepared by applying an acryl emulsion adhesive (a weak adhesive) (product name: PA-310, manufacturer: REGITEX Co., Ltd.) to give a deposition amount of 15 g/m$^2$ were used.

Example 2

A thermosensitive recording material of Example 2 was obtained in the same manner as in Example 1, provided that the is support was changed to a 100 μm-thick synthetic resin containing polypropylene (PL-100, of NAN YA PLASTICS CORPORATION, density: 76 g/m$^2$, surface wettability: 40 dyn/cm).

Example 3

A thermosensitive recording material of Example 3 was produced in the same manner as in Example 1, provided that the support was changed to a 100 μm-thick PET film (density: 140 g/m$^2$, surface wettability: 32 dyn/cm).

Example 4

A thermosensitive recording material of Example 4 was obtained in the same manner as in Example 1, provided that the amount of the oxazoline crosslinking agent in [Liquid E] was changed from 13 parts to 33 parts, and the amount of water therein was changed from 23 parts to 46 parts.

Example 5

A thermosensitive recording material of Example 5 was obtained in the same manner as in Example 1, provided that the amount of the oxazoline crosslinking agent in [Liquid E] was changed from 13 parts to 2 parts, and the amount of water therein was changed from 23 parts to 9 parts.

Example 6

A thermosensitive recording material of Example 6 was obtained in the same manner as in Example 1, provided that as an antistatic agent, 8 parts of polystyrene aluminum sulfonate (Chemistat SA-101, manufactured by Sanyo Chemical Industries, Ltd., solid content: 33%) was added to [Liquid E].

Example 7

A thermosensitive recording material of Example 7 was obtained in the same manner as in Example 1, provided that as an antistatic agent, 26 parts of acrylic polymer (WS-52U, manufactured by Shin-Nakamura Chemical Co., Ltd., solid content: 10%) was added to [Liquid E].

Example 8

A thermosensitive recording material of Example 8 was obtained in the same manner as in Example 7, provided that the support was changed to a 100 μm-thick synthetic resin containing polypropylene (PL-100, of NAN YA PLASTICS CORPORATION, density: 76 g/m$^2$, surface wettability: 40 dyn/cm).

Comparative Example 1

A thermosensitive recording material of Comparative Example 1 was obtained in the same manner as in Example 1, provided that the support was changed to a 100 μm-thick paper (density: 105 g/m$^2$).

Comparative Example 2

A thermosensitive recording material of Comparative Example 2 was obtained in the same manner as in Example 2, is provided that the core-shell acrylic emulsion was removed from [Liquid E], and the amount of water therein was changed to 16 parts.

Comparative Example 3

A thermosensitive recording material of Comparative Example 3 was obtained in the same manner as in Comparative Example 2, provided that 34 parts of the aqueous acryl in [Liquid E] was replaced with 17 parts of an acrylic emulsion (JONCRYL PDX-7370, manufactured by BASF JAPAN, solid content: 42%).

Comparative Example 4

A thermosensitive recording material of Comparative Example 4 was obtained in the same manner as in Example 2, provided that the oxazoline crosslinking agent was removed from [Liquid E], and the amount of water therein was changed from 23 parts to 29 parts.

Comparative Example 5

A thermosensitive recording material of Comparative Example 5 was obtained in the same manner as in Example 2, provided that the oxazoline crosslinking agent in [Liquid E] was replaced with a carbodiimide crosslinking agent (CARBODILITE V-02-L2, manufactured by Nisshinbo Chemical Inc. solid content: 40%).

Comparative Example 6

A thermosensitive recording material of Comparative Example 6 was obtained in the same manner as in Example 2, provided that 13 parts of the oxazoline crosslinking agent in [Liquid E] was replaced with 21 parts of a polyamide epichlorohydrin crosslinking agent (WS-4024, manufactured by Seiko PMC Corporation, solid content: 25%), and the amount of water therein was changed from 23 parts to 15 parts.

Comparative Example 7

A thermosensitive recording material of Comparative Example 7 was obtained in the same manner as in Example 2, provided that 13 parts of the oxazoline crosslinking agent in [Liquid E] was replaced with 26 parts of a zirconium crosslinking agent (Baycoat 20, Nippon Light Metal Co., Ltd., solid content: 20%), and the amount of water therein was changed from 23 parts to 10 parts.

Comparative Example 8

A thermosensitive recording material of Comparative Example 8 was obtained in the same manner as in Example 2, provided that 13 parts of the oxazoline crosslinking agent in [Liquid E] was replaced with 5 parts of an aziridine crosslinking agent (Che tite PZ-33, manufactured by Nippon Shokubai Co., Ltd., solid content: 100%), and the amount of water therein was changed from 23 parts to 31 parts.

Comparative Example 9

A thermosensitive recording material of Comparative Example 9 was obtained in the same manner as in Example 2, provided that 64 parts of the core-shell acrylic emulsion in [Liquid E] was replaced with 29 parts of an acrylic emulsion (JONCRYL PDX-7370, manufactured by BASF JAPAN, solid content: 42%), and the amount of water therein was changed from 23 parts to 59 parts.

Water resistance of the prepared thermosensitive recording material, adhesion between the support and the back layer, variation with time in adhesion between the support and the back layer, curl of hot-melt adhesive label, and stability of the back layer coating liquid were evaluated in the following manners.

The evaluation results are presented in Table 1.

(Water Resistance)

Each thermosensitive recording material to which curing was performed without providing an adhesive layer was used as a sample. After immersing the thermosensitive recording material in water for 30 minutes, a surface of the thermosensitive recording material at the side where the back layer had been provided was rubbed with a finger, and the number of rubbing till the back layer peeled was measured.

I: 51 times or more of rubbing with a finger for testing water resistance

II: 31 times to 50 times of rubbing with a finger for testing water resistance

III: 30 times or less of rubbing with a finger for testing water resistance (Adhesion Between Support and Back Layer)

Each thermosensitive recording material to which curing was performed without providing an adhesive layer was used as a sample. After immersing the thermosensitive recording material in water for 30 minutes, an adhesive tape was stuck on a surface of the thermosensitive recording material at the side where the back layer had been provided. The manner how the adhesive tape was peeled, and the peeled state of the back layer were evaluated.

I: The back layer was not peeled when the adhesive tape was quickly peeled at an angle of 90 degrees with respect to the sample.

II: The back layer was peeled when the adhesive tape was quickly peeled at an angle of 90 degrees with respect to the sample.

III: The back layer was peeled even when the adhesive tape was slowly peeled at an angle of 90 degrees with respect to the sample.

IV: The back layer was peeled even when the adhesive tape was slowly peeled at an angle of 180 degrees with respect is to the sample.

(Variation with Time in Adhesion Between Support and Back Layer after Applying Adhesive)

An adhesive layer containing a common adhesive, and an adhesive layer containing a releasable weak adhesive were each separately provided on the back layer of the thermosensitive recording material. The prepared thermosensitive recording materials were each stored for 1 weak in the environment of 40° C., 90% RH. Then, an adhesive tape was stuck on the surface of the adhesive layer, and the adhesive tape was peeled off at the speed of 70 m/min. Thereafter, the state of the back layer peeled was evaluated.

A: Peeling occurred in the adhesive layer, or between the adhesive layer and the back layer, not between the back layer and the support. Alternatively, the adhesive tape was torn.

B: Peeling occurred partially between the back layer and the support.

C: Peeling occurred between the back layer and the support.

(Curling of Hot-Melt Adhesive Label)

Each thermosensitive recording material having an adhesive layer containing a hot-melt adhesive was used, and from which release paper was peeled off. Then, the thermosensitive recording material was moisture-conditioned for 3 hours in the environment of 20° C., 65% RH, followed by measuring a curling amount (mm).

(Stability of Back Layer Coating Liquid)

After preparing a back layer coating liquid, the back layer coating liquid was left to stand in the environment of ambient temperature. The time lapsed till the coating liquid increased its viscosity or the coating liquid started to turn cloudy was measured.

A: Four days or longer but shorter than 30, which was no problem.

B: One day or longer but shorter than 4 days, which was no problem.

C: The aforementioned changes of the coating liquid appeared within the period of shorter than 24 hours.

TABLE 1

| | Water resistance | Adhesion between support and back layer | Variation with time in adhesion between support and back layer after applying adhesive | | Curling of hot-melt adhesive label | Stability of back liquid |
|---|---|---|---|---|---|---|
| | | | Normal adhesive | Weak adhesive | | |
| Ex. 1 | I | II | A | A | 1 | A |
| Ex. 2 | I | I | A | A | 1 | A |
| Ex. 3 | I | II | A | A | 1 | A |
| Ex. 4 | I | I | A | B | 4 | A |
| Ex. 5 | II | II | A | A | 3 | A |
| Ex. 6 | II | I | A | A | 2 | A |
| Ex. 7 | I | I | A | A | 1 | A |
| Ex. 8 | I | I | A | A | 1 | A |
| Comp. Ex. 1 | III | I | A | A | 0 | A |
| Comp. Ex. 2 | I | I | A | C | 20 | A |
| Comp. Ex. 3 | I | I | A | C | 1 | A |
| Comp. Ex. 4 | I | I | A | C | 20 | A |
| Comp. Ex. 5 | III | IV | C | C | 18 | A |
| Comp. Ex. 6 | III | II | A | C | 22 | A |
| Comp. Ex. 7 | I | IV | C | C | 3 | B |
| Comp. Ex. 8 | III | III | B | B | 25 | A |
| Comp. Ex. 9 | I | I | A | A | 1 | C |
| Comp. Ex. 10 | I | I | C | C | 19 | A |

The invention claimed is:

1. A thermosensitive recording material, comprising:

a support;

a thermosensitive recording layer provided on one surface of the support; and a back layer provided on the other surface of the support, wherein the support has a surface formed of a resin, and wherein the back layer contains a combination of a core-shell acrylic resin and an oxazoline resin, or a reaction product thereof, or both thereof.

2. The thermosensitive recording material according to claim 1, wherein the oxazoline resin is contained in an amount of 0.1 parts to 1.2 parts relative to 1 part of the core-shell acrylic resin.

3. The thermosensitive recording material according to claim 1, wherein the support is synthetic paper.

4. The thermosensitive recording material according to claim 3, wherein the synthetic paper contains popypropylene.

5. The thermosensitive recording material according to claim 1, wherein the surface of the support on which the back layer is provided has wetting index of 40 dyn/cm or higher.

6. The thermosensitive recording material according to claim 1, wherein the back layer further contains an antistatic agent.

7. The thermosensitive recording material according to claim 6, wherein the antistatic agent is acrylic polymer.

8. The thermosensitive recording material according to claim 1, further comprising an adhesive layer provided on the back layer.

9. The thermosensitive recording material according to claim 8, wherein the adhesive layer contains a releasable weak adhesive.

10. The thermosensitive recording material according to claim 8, wherein the adhesive layer contains a hot-melt adhesive.

* * * * *

UNITED STATES PATENT AND TRADEMARK OFFICE

CERTIFICATE OF CORRECTION

PATENT NO. : 9,023,756 B2
APPLICATION NO. : 14/005444
DATED : May 5, 2015
INVENTOR(S) : Kenji Shimizu, Hideo Aihara and Daiki Iwata It is certified that error appears in the above-identified patent and that said Letters Patent is hereby corrected as shown below:

On the title page

Add the following item (30) Foreign Application Priority Data to the cover page of the patent:

--(30) Foreign Application Priority Data:
July 29, 2011 (JP) 2011-166690--.

Signed and Sealed this
Ninth Day of February, 2016

Michelle K. Lee

Michelle K. Lee
*Director of the United States Patent and Trademark Office*